United States Patent [19]

Lonati

[11] 4,391,105

[45] Jul. 5, 1983

[54] YARN FEED UNIT IN A SINGLE-CYLINDER CIRCULAR KNITTING MACHINE

[75] Inventor: Francesco Lonati, Brescia, Italy

[73] Assignee: Costruzioni Meccaniche Lonati S.p.A., Brescia, Italy

[21] Appl. No.: 244,472

[22] Filed: Mar. 16, 1981

[30] Foreign Application Priority Data

Apr. 1, 1980 [IT] Italy ..... 21362/80[U]

[51] Int. Cl.[3] ..... D04B 15/58

[52] U.S. Cl. ..... 66/138; 66/125 R

[58] Field of Search ..... 66/125 R, 131, 133, 66/138, 139, 140 R

[56] References Cited

U.S. PATENT DOCUMENTS

| | | | |
|---|---|---|---|
| 2,948,131 | 8/1960 | Levin | 66/138 |
| 3,201,957 | 8/1965 | Levin | 66/138 |
| 3,296,836 | 1/1967 | Billi | 66/138 |
| 3,555,855 | 1/1971 | Billi | 66/138 |
| 4,120,179 | 10/1978 | Michelletti | 66/140 R X |

FOREIGN PATENT DOCUMENTS

| | | | |
|---|---|---|---|
| 2237712 | 7/1973 | Fed. Rep. of Germany | 66/125 R |
| 1007670 | 10/1965 | United Kingdom | 66/140 R |

*Primary Examiner*—Wm. Carter Reynolds

*Attorney, Agent, or Firm*—Guido Modiano; Albert Josif

[57] ABSTRACT

A yarn feed unit for a single-cylinder circular knitting machine comprises a plurality of yarn feeding fingers independently journalled to a common axis and independently movable between an inoperative and an operative position. The axis is supported by a carrier body which is radially displaceable with respect to the needle cylinder between a work position close to the needle cylinder and a rest position remote from the needle cylinder. Movement of the carrier body from the work position to the rest position causes the operative yarn feeding fingers to be simultaneously tilted into the inoperative position and all the yarn feeding fingers to be radially withdrawn from the needle cylinder, thus allowing rotation of the needle cylinder and needle dial to set the machine without any risk of damaging the needles and without manually handling the dial needles.

5 Claims, 3 Drawing Figures

YARN FEED UNIT IN A SINGLE-CYLINDER CIRCULAR KNITTING MACHINE

BACKGROUND OF THE INVENTION

This invention relates to an improved yarn feed unit in a single-cylinder circular knitting machine, in particular a hose or the like knitting machine.

It is known that such yarn feed units generally comprise a number of yarn feeding fingers, e.g. five feeding fingers arranged side-by-side and independently journalled about a common axis. The yarn feeding fingers are movable independently of one another between an inoperative position, whereat their yarn guiding ends are sufficiently removed from the needle cylinder to prevent the needles from picking up the yarn, and an operative position very close to the needle cylinder, such that the needles are enabled to pick up the yarn. The yarn feeding fingers are controlled by the machine program, more specifically by the main programming drum, such as through Bowden cable controls.

The yarn feeding fingers are usually carried on a support or holder attached to a stationary portion of the machine. In this case, it is also possible to bring them all simultaneously to said inoperative position, e.g. whenever the dial is to be removed for inspection or repair, or when the machine must be reset on account of some failure. To simultaneously bring all of the yarn feeding fingers to their inoperative position, an arm is provided which is journalled to the same axis as the feeding fingers and has a small plate mounted at its bottom effective to raise all the yarn feeding fingers upon the arm itself being raised. The latter raising movement is accomplished by means of a rotatable horizontal ring which is formed at the top with a contoured profile adapted to engage a portion of said arm and either raise or lower the arm, depending on the ring direction of rotation.

The above yarn feeding units, however, still interfere with the dial raising and machine setting operations, even after the feeding fingers have been withdrawn to their inoperative position, the machine setting being an operation which involves of necessity the raising of the dial. It may happen, in fact, that the dial needles, in their protruding positions from the respective tricks, strike the yarn feeding fingers and become damaged, the needle latches being particularly prone to this trouble. Thus, a manual setting or re-insertion of the dial needles into the respective tricks must be resorted to before the dial can be raised and the setting carried out. The net result is a substantial increase of downtime and overall costs.

Also known are machines wherein the yarn feeding units are mounted on the same structure which carries the dial, thereby they can be tilted along with the dial where the latter is tilted for the aforementioned operations. This arrangement, however, also fails to prevent possible interference between the yarn feeding fingers and the dial needles, inasmuch as it does not allow all of the feeding fingers to be raised as a whole. Therefore, this known approach also requires manual setting of the dial needles, which is time consuming.

SUMMARY OF THE INVENTION

This invention sets out to obviate the drawbacks cited above in conventional yarn feeding units, by providing an improved yarn feeding unit which affords a highly reliable raising of the dial without requiring any prior manual setting of the needles, and even enables the machine to be reset automatically.

Within the above general aim, it can be further arranged that the yarn feeding unit according to this invention has a simple and economically favorable construction.

According to one aspect of the present invention, there is provided an improved yarn feed unit in a single-cylinder circular knitting machine, in particular a hose or the like knitting machine, comprising a plurality of yarn feeding fingers arranged side-by-side and independently journalled about a common axis, said yarn feeding fingers being movable independently of one another between inoperative and operative positions, and an arm journalled to the same axis as said yarn feeding fingers and provided at the bottom thereof with a small plate extending underneath all of said yarn feeding fingers, as well as a means for raising said arm and along therewith, through the intermediary of said small plate, all of said yarn feeding fingers at once to a rest position substantially coincident with said inoperative position, the unit being characterized in that said axis is supported by a carrier body substantially radially movable relative to the machine between a position close to the needle cylinder and a position away or remote from the needle cylinder, and in that said means for raising said arm is configured and arranged to implement the raising of said arm upon said carrier body being moved to said position away from the needle cylinder.

BRIEF DESCRIPTION OF THE DRAWING

Further features and advantages of the invention will be more clearly understood from the following detailed description of a preferred embodiment thereof, with reference to the accompanying drawings, where.

DESCRIPTION OF THE PREFERRED EMBODIMENTS

Figure 1:
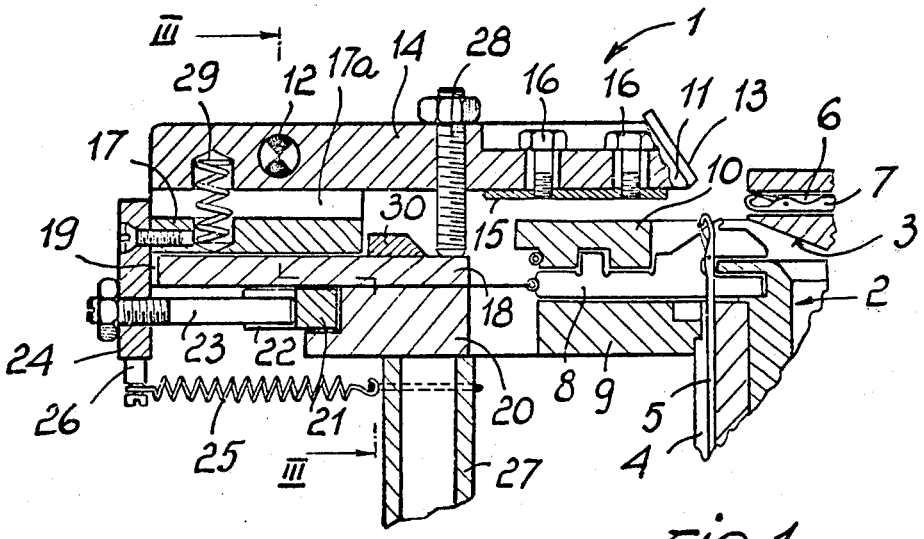
FIG. 1 is a sectional view of the yarn feed unit according to the invention, taken on a plane lying substantially radially and axially to the knitting machine needle cylinder, which plane is indicated at I—I in FIG. 3, the unit being shown in its working or operative position.

With reference to the drawing figures, there is generally shown and indicated at 1 the yarn feed unit of this invention, which is represented for illustrative purposes as installed in a circular knitting machine of the needle cylinder and needle dial type, the needle cylinder being indicated at 2 and the dial at 3. In the tricks 4 of the cylinder 2, there are slidingly movable knitting needles 5, while in the radial tricks 6 of the dial 3 there are slidingly movable knitting needles 7. For completeness sake, sinkers 8 are also shown which are of conventional design and movable radially in grooves of a supporting ring 9, under control by a fixed ring 10.

The yarn feed unit 1 comprises, in a manner known per se, a plurality of yarn feeding fingers 11 arranged in side-by-side relationship and independently journalled to a common axis, defined by a horizontal pivot pin 12. Each yarn feeding finger 11 has at its free end a sloping tubular guide 13, wherethrough a yarn is supplied to the machine needles.

The feeding fingers 11 are movable, about the pivot pin 12, in a known manner between an operative position, whereat the end carrying the tubular guide 13 is positioned to allow the needles 5 and 7 to pick up the yarn, and an inoperative position, whereat the feeding fingers are raised up and the end with the tubular guide 13 is moved away from the needles 5 and 7 such that the latter cannot pick up the yarn passed through their respective tubular guides 13. The yarn feeding fingers are individually controlled between the two positions in a conventional manner, through means not shown, e.g. Bowden cables.

The yarn feeding fingers 11, moreover, can be brought all together to their inoperative positions. For this purpose, there is provided, in a manner known per se, a control arm 14 which is journalled to the same pivot pin 12 and arranged to extend parallel to the yarn feeding fingers 11 located on the outward portion of the feeding finger 11 assembly. At the free end bottom, the arm 14 carries a small plate 15 which extends perpendicularly to the plane of movement of the arm, that is parallel to the pin 12, and has such a size as to extend underneath all of the feeding fingers 11. The plate 15 can be secured to the arm 14 as by screws 16. The raising of the arm 14, which is effected through a means which will be described hereinafter, results, owing to the provision of the plate 15, in the simultaneous raising of all the yarn feeding fingers 11 to a rest position which substantially coincides with the cited inoperative position.

According to the invention, the pivot pin 12 is supported on a carrier body 17 which is movable substantially radially to the machine, between a position close to the needle cylinder 2, and a position away therefrom. More in detail, the carrier body 17 has a substantially U-like shape and accommodates the pivot pin 12 in its wings 17*a*, as well as a section of the feeding fingers 11 and arm 14 between its wings 17*a*. It is slidably mounted on a fixed or stationary guide 18, which extends in a substantially radial direction with respect to the cylinder 2 and dial 3 and has a preferably dovetailed cross-sectional configuration slidably engaging a mating seat 19 formed on the bottom face of the carrier body 17. The guide 18 is attached to the stationary portion 20 of the machine.

For displacing the carrier body 17 along the guide 18, a means is provided which comprises a horizontal ring 21 rotatably received in the stationary portion 20 of the machine, concentrically thereto. The ring 21 is formed, on the outward peripheral surface thereof, with a ramp 22 sloping down in the direction of movement of the ring 21 and being engaged by the tip of a follower member like a pin or screw 23, which extends parallel to the guide 18 and is adjustably fastened, preferably by thread engagement, to a mounting plate 24, in turn secured to the carrier body 17. A spring 25, stretched between a pin 26 projecting from the plate 24 and an upright 27 or other element of the machine stationary portion, acts to pull the carrier body 17 toward the needle cylinder 2. It will be appreciated that a rotation of the ring 21 as imparted, for example, under control by the machine main drum, will result, upon the screw 23 contacting and following the ramp 22, in a displacement of the carrier body 17 radially to the machine in either direction depending on the direction of rotation of the ring 21.

The arm 14 further carries, at a middle area thereof, an adjustable follower means like a pin or screw 28, directed substantially downwards in the plane of movement of the arm. The screw 28 will normally rest on the top surface of the fixed guide 18, thus holding the entire unit in the working position shown in FIG. 1. That rest condition is maintained by a spring 29 accommodated in aligned recesses on the carrier body 17 and arm 14 on the side of the pivot pin 12 remotely located from that carrying the screw 28.

Between the point of contact of the screw 28 with the unit in its working position (FIG. 1) and the carrier body 17, the guide 18 has a raised portion 30 formed thereon with a ramp 30*a* facing the cylinder 2 and dial 3, and with an elevated substantially horizontal surface 30*b* located on the same side as the carrier body 17.

Figure 2:
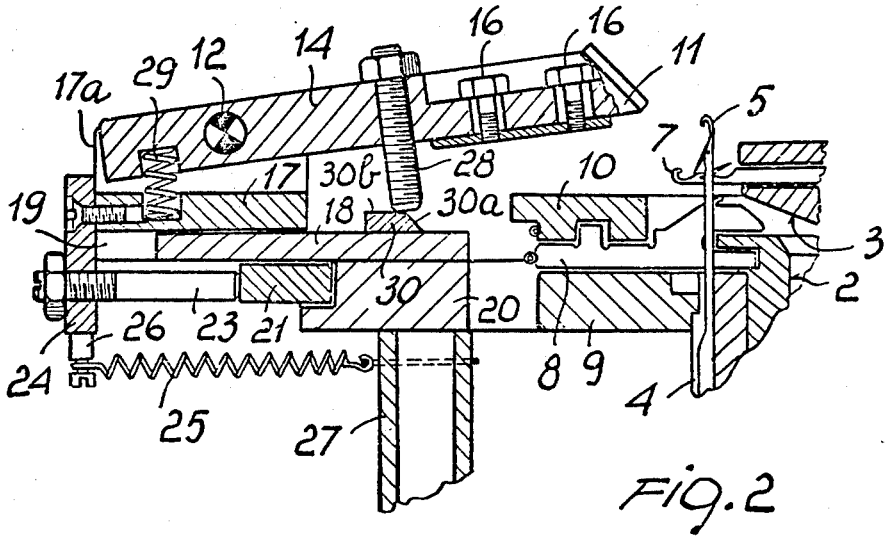
FIG. 2 is a sectional view similar to FIG. 1, but with the unit shown in its rest or inoperative position.
Figure 3:
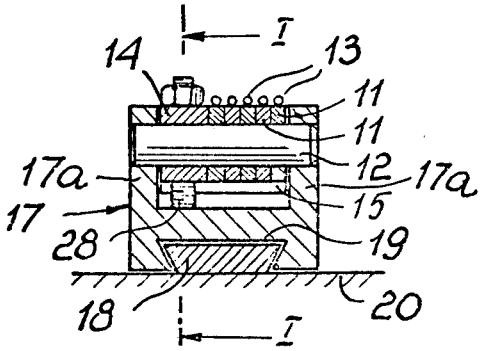
FIG. 3 is a sectional view taken along the line III—III of FIG. 1.

It will be apparent how a radial displacement of the carrier body 17, as effected in the manner described hereinabove, will result in the screw 28 climbing the raised portion 30 and accordingly in the raising of the arm 14 and all the yarn feeding fingers 11 together into the rest position shown in FIG. 2, whereat the yarn feeding fingers are also spaced apart from the needle cylinder 2 and dial 3 by a sufficient distance to prevent any interference of the needles 5 and 7 with the feed unit 1. In fact, even though the needles 5 of the cylinder 2 and needles 7 of the dial 3 are in their outermost positions, as shown in FIG. 2, it becomes possible to rotate the cylinder 2 and dial 3, and thus automatically set the machine, without any risk of breaking the needles and without manually handling the dial needles. It is similarly possible to remove the dial 3 with the needles 7 in the outward position.

It will be apparent from the foregoing description that the invention provides a simple and inexpensive feed unit which also affords considerable time economies, since with a single operation—i.e. through the rotation of the ring 21 under control by the machine drum,—the yarn feeding fingers can be positioned such that any chance of breaking or damaging the needles is ruled out, while the machine can be set in a fully automatic manner by simply rotating it.

It should be noted that the yarn feeding unit as described and illustrated herein may also be applied to single-cylinder machines having a dial equipped with welt hooks instead of needles.

I claim:

1. An improved yarn feed unit in a single-cylinder circular knitting machine, in particular a hose or the like knitting machine, comprising a plurality of yarn feeding fingers arranged side-by-side and independently journalled about a common axis, said yarn feeding fingers being movable independently of one another between inoperative and operative positions, an arm journalled to said common axis and having a small plate secured thereto and extending underneath all of said yarn feeding fingers, means for raising said arm and along therewith, through the intermediary of said small plate, all of said yarn feeding fingers at once to a rest position substantially coincident with said inoperative position, a carrier body supporting said axis, means for substantially radially displacing said carrier body between a position close to said needle cylinder and a position remote from said needle cylinder, said means for raising said arm being operative upon said carrier body being displaced to said position remote from said needle cylinder.

2. A yarn feed unit according to claim 1, wherein said means for substantially radially displacing said carrier body comprise a stationary portion of the machine, a horizontal ring rotatably received in said stationary portion of the machine and having an outward peripheral surface, a ramp on said outer peripheral surface sloping in the direction of rotation of said ring, a follower member rigid with said carrier body and engaging said outer peripheral surface and said ramp of said ring, and resilient means for urging said follower member into engagement with said outer peripheral surface of said ring.

3. A yarn feed unit according to claim 2, wherein said means for substantially radially displacing said carrier body further comprise a mounting plate attached to said carrier body, said mounting plate adjustably supporting said follower member.

4. A yarn feed unit according to claim 1, wherein said means for raising said arm comprise a stationary portion of the machine, a raised portion on said stationary portion of the machine, said raised portion having a sloping ramp facing said needle cylinder and an elevated substantially horizontal surface between said sloping ramp and said carrier body, a follower means rigid with said arm for engaging said raised portion during at least part of the displacing movement of said carrier body.

5. A yarn feed unit according to claim 1, wherein said carrier body has a bottom face defining a seat for slidingly receiving a guide rigid with a stationary portion of the machine, said seat and guide having preferably mating dovetailed cross-sectional configurations.

* * * * *